US007431525B2

(12) United States Patent
Anderson

(10) Patent No.: US 7,431,525 B2
(45) Date of Patent: Oct. 7, 2008

(54) BATH BRUSH

(76) Inventor: Todd A. Anderson, 2983 Dorothy Dr., Aurora, IL (US) 60504

( * ) Notice: Subject to any disclaimer, the term of this patent is extended or adjusted under 35 U.S.C. 154(b) by 134 days.

(21) Appl. No.: 11/093,344

(22) Filed: Mar. 30, 2005

(65) Prior Publication Data

US 2006/0225232 A1 Oct. 12, 2006

(51) Int. Cl.
*A46B 11/02* (2006.01)
*A46B 5/02* (2006.01)
*A46B 11/04* (2006.01)

(52) U.S. Cl. ..... 401/188 R; 401/6; 401/270

(58) Field of Classification Search ..... 401/188 R, 401/6, 270, 278, 286
See application file for complete search history.

(56) References Cited

U.S. PATENT DOCUMENTS 2,204,200 A * 6/1940 Wisner ..... 222/209
4,171,171 A * 10/1979 Jones ..... 401/150
4,861,180 A * 8/1989 Adams ..... 401/195
6,036,391 A * 3/2000 Holliday et al. ..... 401/188 R
6,983,866 B2 * 1/2006 Smart et al. ..... 222/192

* cited by examiner

*Primary Examiner*—David J Walczak
(74) *Attorney, Agent, or Firm*—Vedder Price P.C.; W. Dennis Drehkoff

(57) ABSTRACT

A bath brush comprises a handle attached to a bristle block that contains bristles. A tank mounted inside the handle can be filled with liquid soap, liquid detergent, or other liquids to be used in washing the body. A pushbutton connected to a pump allows a user to select a measured amount of liquid while keeping the liquid from spilling, as it may when poured from a bottle. A check valve keeps liquid from running back into the tank and another check valve passes liquid from the pump to the bristle block but prevents anything from running back into the pump. While the bath brush is useful for anyone who is showering, bathing in a tub, or taking a sponge bath, it is especially useful for someone whose balance is compromised enough that he or she needs to hold on to something in the shower.

4 Claims, 6 Drawing Sheets

BATH BRUSH

BACKGROUND OF THE INVENTION

This invention relates to bath brushes. In particular, it is a bath brush with a reservoir that allows the application of measured amounts of fluids such as liquid soap, liquid detergent, ointment, or the like, to a bather in a tub, shower, or the like.

Bath brushes are well known, especially those intended to scrub the back. A bath brush includes a handle attached to bristles of some sort that lets a bather scrub any area of the body, including the back, which is otherwise not easily reached. A bather in a shower or tub may wish to apply liquid soap, liquid detergent, or some sort of lotion, ointment, or emollient to any part of the body, including the back. A conventional way to do this is to rub a soap bar with the bristles of a brush, to rub the soap bar on a hand or a washcloth and apply it to the body, or to apply the liquid soap, detergent, or lotion by pouring it onto the body or by pouring it into a hand and rubbing it onto the body. In any of these ways of applying soap, liquid detergent, ointment, lotion, or the like, it is difficult to measure the amount of substance applied to the body. It is also generally necessary to use two hands to apply the soap, liquid detergent, or other substance to the body. This can be difficult for persons whose balance is not good.

It would be an advantage to have a way of applying a measured amount of liquid to the body with a bath brush that can be held in one hand and then scrubbing with the brush to use the measured amount of liquid for cleansing or other treatment. This allows the user of the bath brush to economize on the amount of liquid soap, detergent, ointment, lotion, or the like, and also allows the user to apply desired measures of such substances to the body.

On some occasions, such as taking a sponge bath, it may also be desirable to apply a mixture of water with other liquids such as liquid soap, liquid detergent, or the like, when the user is not in a bathtub or shower. In addition to the convenience of having the mixture of liquid soap or the like in a single place, the user is enabled to reach any part of the body using only one hand.

SUMMARY OF THE INVENTION

The foregoing advantages and others are achieved by a bath brush that comprises a handle containing a reservoir for a liquid and a pump that delivers a metered quantity of the liquid through or near the bristles of the brush. This allows a user to deliver a desired amount of the liquid, which may be soap, liquid detergent, lotion, ointment, or a mixture of some or all of these, to the area that the user proposes to scrub with the brush. The result is to eliminate dropping soap in the bathtub or shower, to control the amount of the liquid being used, and in general to facilitate the bathing or showering process, especially for people who have difficulty for one reason or another in using two hands in performing ablutions.

DETAILED DESCRIPTION OF THE INVENTION

Figure 1:
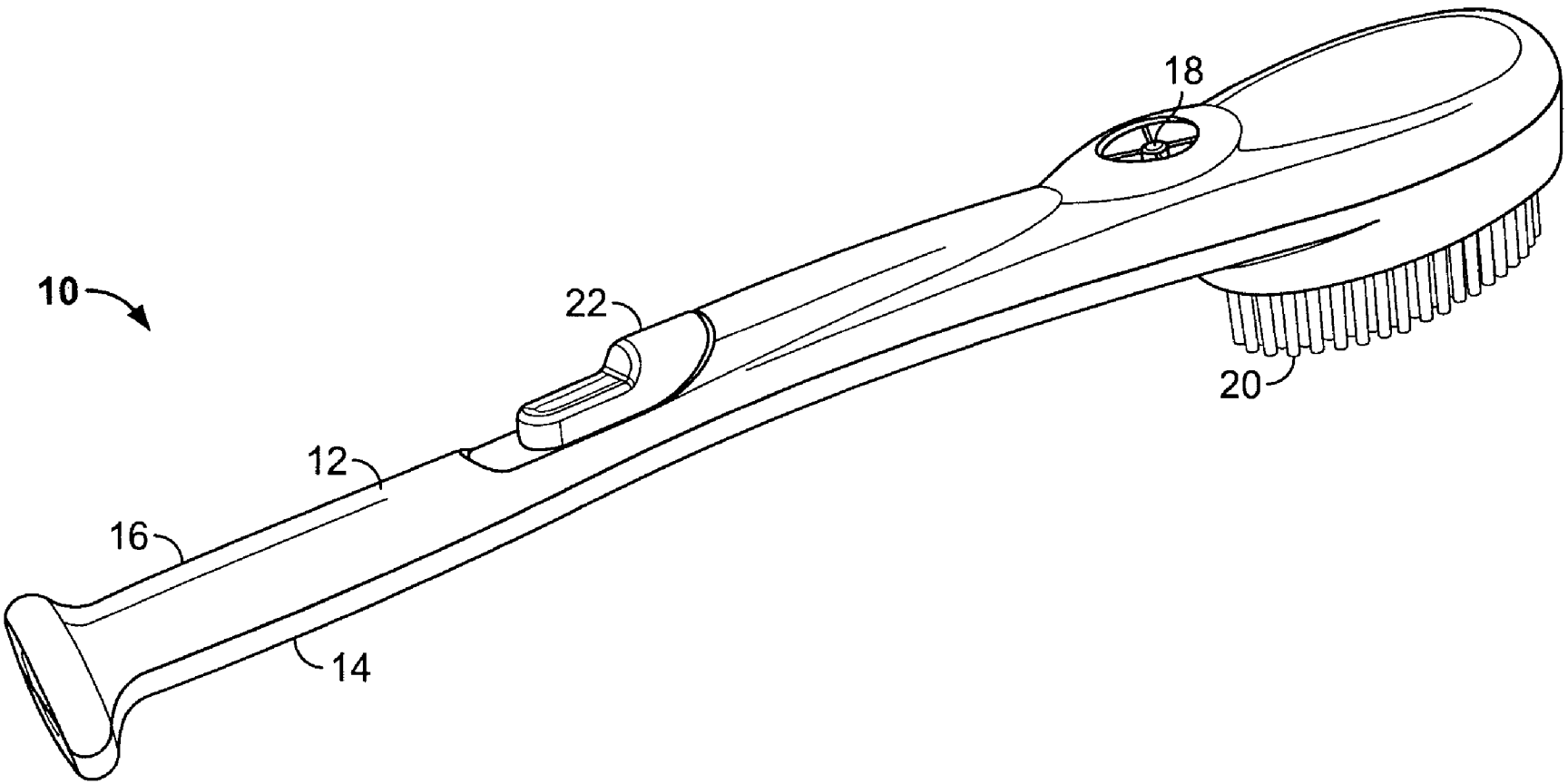
FIG. 1 is a perspective view of an embodiment of the bath brush of the present invention.

FIG. 1 is a perspective view of an embodiment of the bath brush 10 of the present invention. In FIG. 1, an upper brush housing 12 and a lower brush housing 14, made separately for convenience of manufacture, are joined to form a handle 16. The handle 16 receives a twist cap 18 that can be removed to allow a liquid to be poured into the handle and replaced to retain the liquid. Bristles 20 will be seen to receive a liquid that is stored inside the bath brush 10. An actuator 22 is most easily operated by the thumb of a user to dispense a fluid such as a liquid soap or detergent through the bristles 20.

Figure 2:
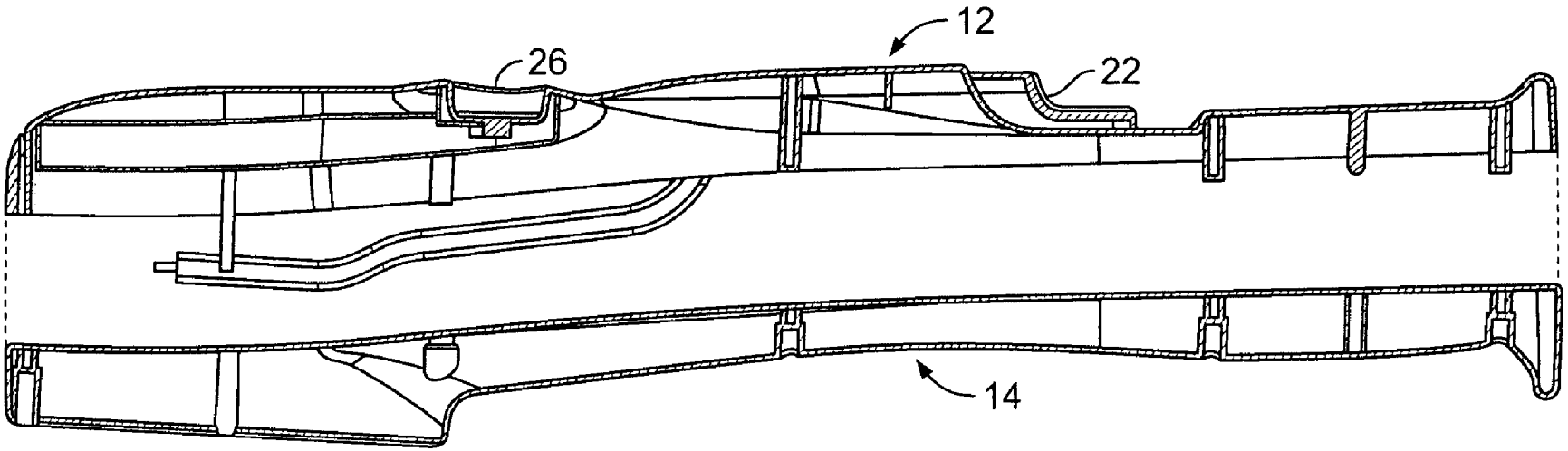
FIG. 2 is a split side view of the parts of the bath brush of the present invention.

FIG. 2 is a split side view of the parts of the bath brush 10 of the present invention. In FIG. 2, the upper brush housing 12 and the lower brush housing 14 are shown separately, before they are joined in the assembly process. The twist cap 18 of FIG. 1 is not shown, but it is to be inserted in a port 26 to admit a desired fluid. The actuator 22 is supported in part by the upper brush housing 12.

Figure 3:
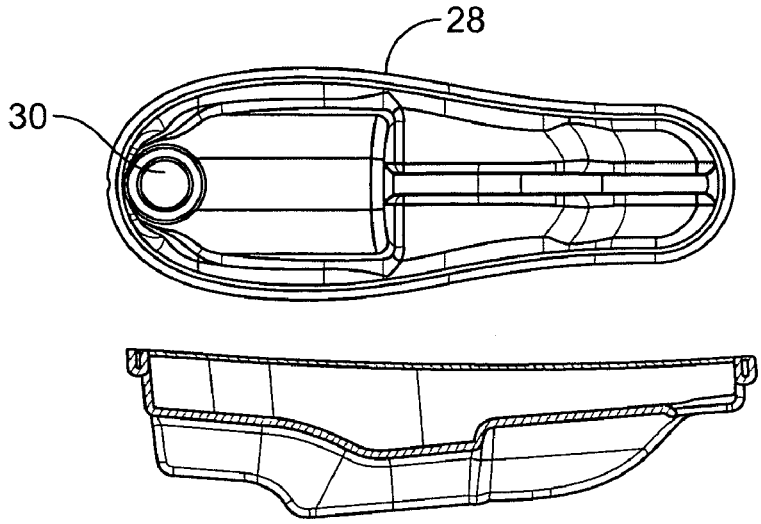
FIG. 3 is a sectional side and top view of the tank of the present invention.

FIG. 3 is a sectional side and top view of the tank 28 of the present invention. In FIG. 3, a port 30 admits fluid to the tank 28 through the port 26 of FIG. 2. The tank 28 is sealed against the inside of the upper half 12 of the bath brush 10.

Figure 4:
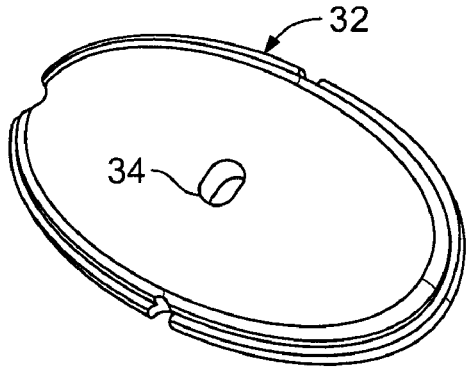
FIG. 4 is a perspective top view of the bristle block assembly of the present invention.

FIG. 4 is a view of the bristle block 32 of the present invention. The bristles 20 of FIG. 1 are not shown here, but they are attached to the bristle block 32. In FIG. 4 the bristle block 32 contains an opening 34 that passes fluid to and through the bristles 20. The bristles 20 are typically made of nylon and the bristle block is typically made of foamed high-density polyethylene (HDPE) or foamed polypropylene, although they may be made of other suitable materials.

Figure 5:
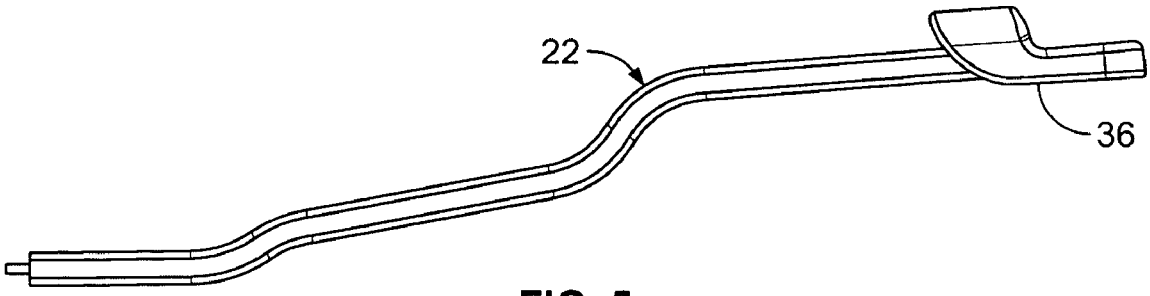
FIG. 5 is a view of the actuator of the present invention.

FIG. 5 is a view of the actuator 22 of the present invention. The actuator 22 includes a thumb button 36 that can be engaged by the thumb of a user to release liquid from the tank 28 when the bath brush 10 is being used. The tank 28 engages the upper housing 12 to form a closed container to hold fluids and supply the fluids for use.

Figure 6:
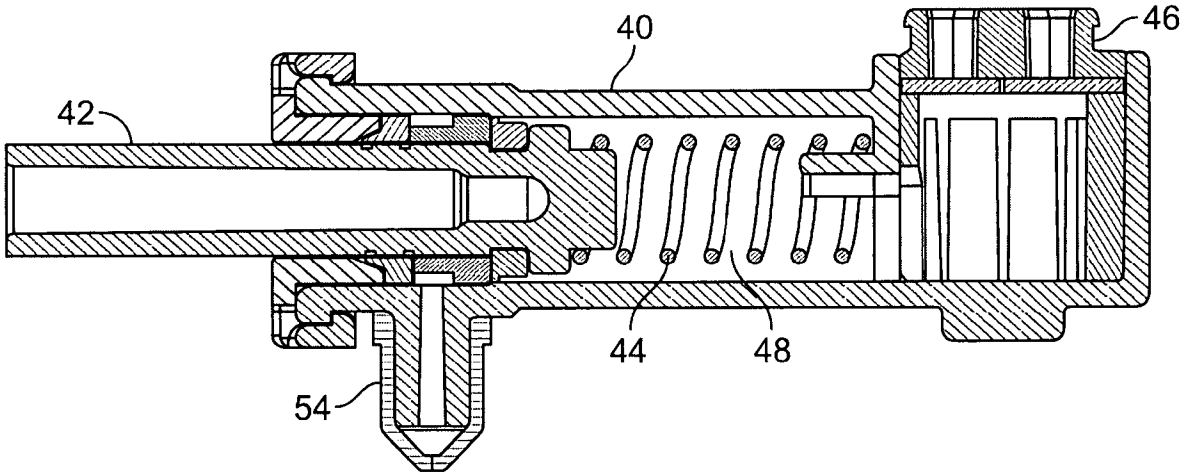
FIG. 6 is a side sectional view of the pump of the present invention when the pump is in a position to fill with fluid.
Figure 7:
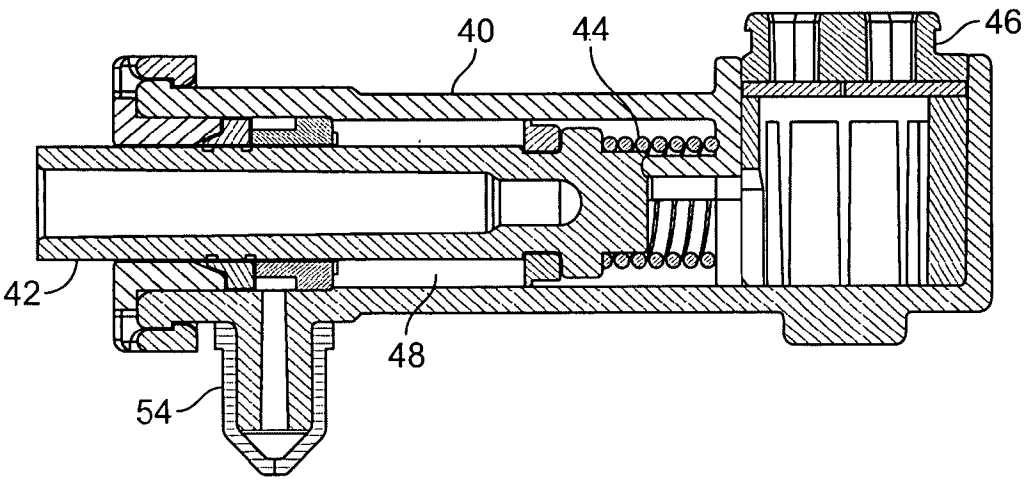
FIG. 7 is a side sectional view of the pump of the present invention when the pump is in a position to deliver fluid to the bristle block.

FIG. 6 is a side sectional view of the pump 40 of the present invention when the pump 40 is in a position to fill with fluid, and FIG. 7 is a side sectional view of the pump 40 of the present invention when the pump 40 is in a position to deliver fluid to the bristle block 32. In FIGS. 6 and 7, a piston 42 is hollow at one end to receive and engage the actuator 22. A spring 44 is relaxed to move the piston 42 to the left in FIG. 6, and the spring 44 is compressed by depressing the actuator 22 in FIG. 7 to move the piston 42 against the spring 44. In operating the bath brush 10, the piston 42 in FIG. 6 will have drawn fluid through a check valve 46 (identified as ball valve 68 in FIG. 11), which is connected to the tank 28 of FIG. 3 to permit fluid to enter the cylinder 48 but will not permit the fluid to be returned to the tank 28. When the actuator 22 is pressed to move the piston 42 to the position shown in FIG. 7, a measured amount of fluid is forced through a nipple 54 that passes through opening 34 and delivers the fluid to the opening 34 in the bristle block of FIG. 4.

Figure 8:
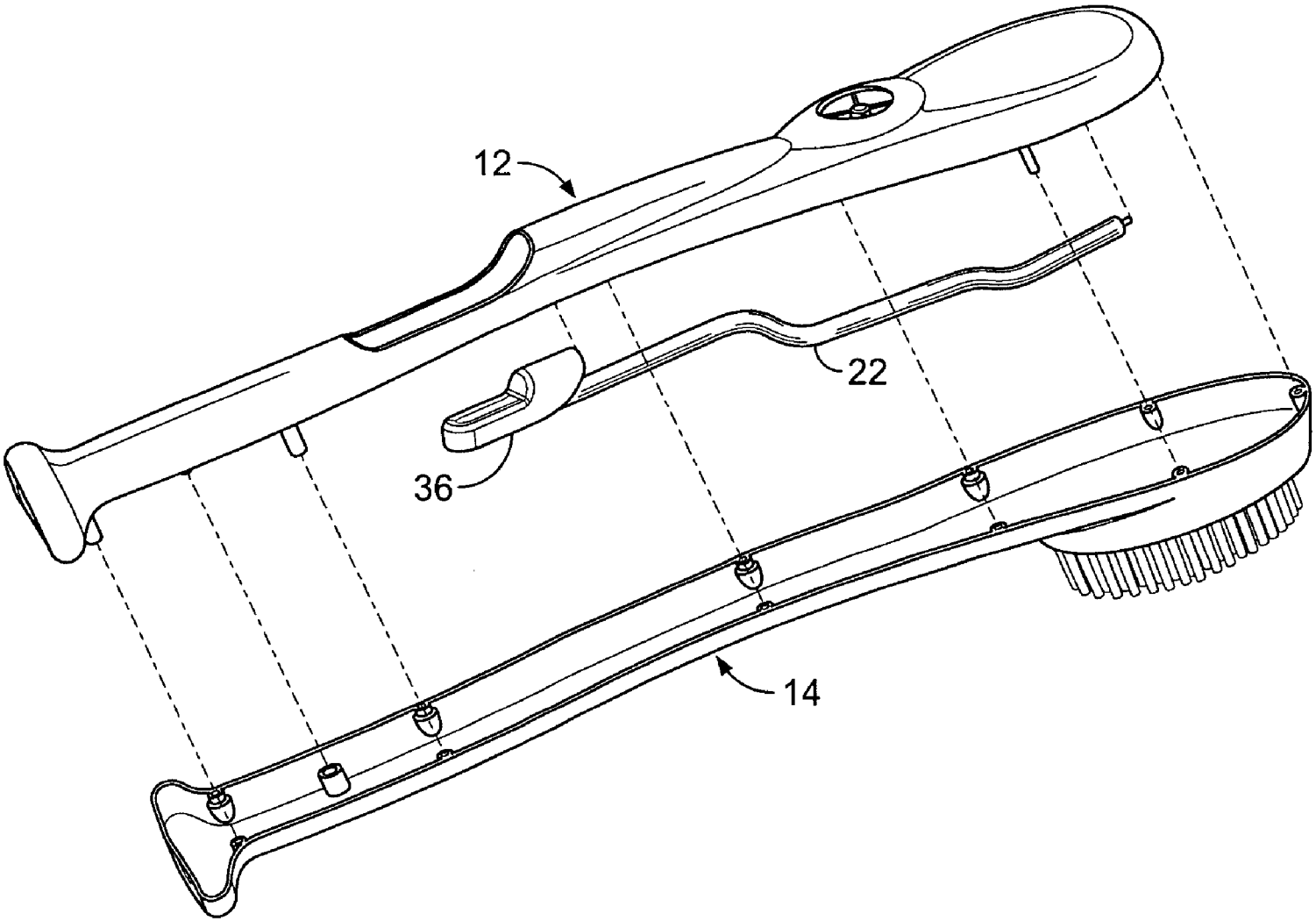
FIG. 8 is an exploded view of the bath brush of the present invention.

FIG. 8 is an exploded view of the bath brush 10 of the present invention showing the assembly of the upper brush housing 12 and the lower brush housing 13.

Figure 9:
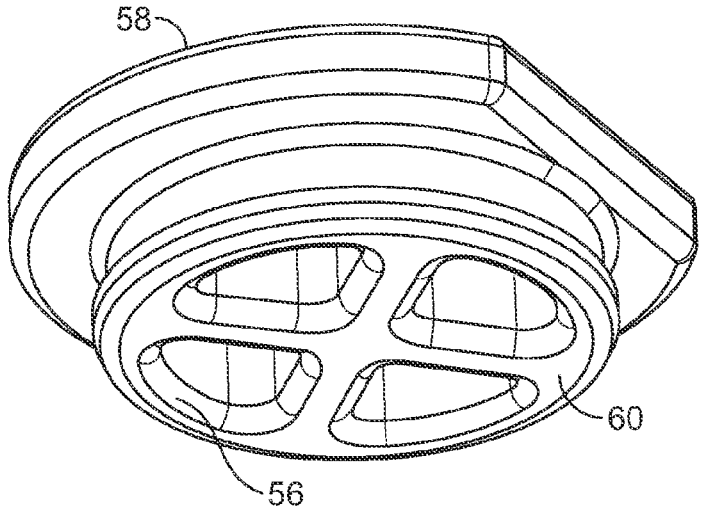
FIG. 9 is a perspective view of the gasket and spacer between the tank and pump of the present invention.

FIG. 9 is a perspective view of the gasket and spacer 56 between the tank 28 and pump 40 of the present invention. In FIG. 9 a plurality of ports permit the flow of fluid between the tank 28 of FIG. 5 and the pump 40 of FIGS. 6 and 7. A side 58 connects to and makes a seal with the tank 28 and a side 60 connects to and makes a seal with the pump 40.

Figure 10:
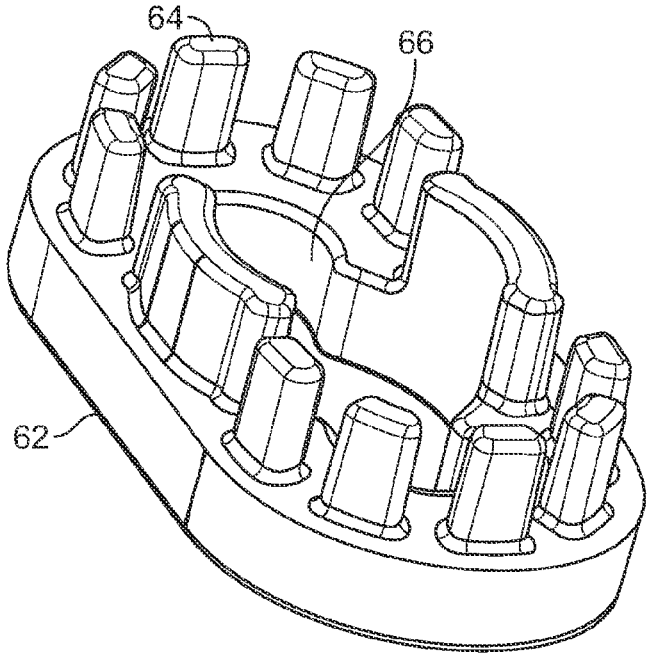
FIG. 10 is a perspective view of a flow-through ring of the present invention.

FIG. 10 is a perspective view of a flow-through ring 62 of the present invention. In FIG. 10, a plurality of nubs 64 engage the pump 40, holding the flow-through ring 62 in place against the pump 40 and making a seal with the pump 40. An opening 66 permits the flow of fluid through the flow-through ring 62.

Figure 11:
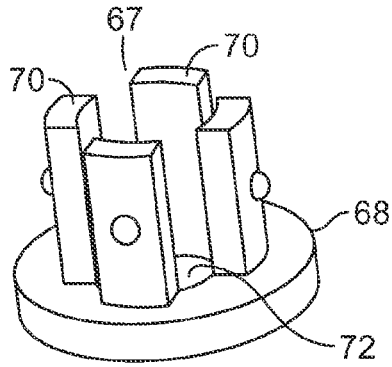
FIG. 11 is a perspective view of a catch for the ball-valve assembly of the present invention.

FIG. 11 is a perspective view of a catch 67 for the ball valve 68 of the present invention. In FIG. 11, a plurality (typically four, as shown here) of supports 70 provide a cage for a spherical ball of plastic or the like (not shown here) that permits flow through an opening 72 and seats against the ball valve 68 to prevent that flow.

When the bath brush 10 is assembled, the upper housing 12 and the lower housing 14 are connected together. The bristle block assembly 20 and the bristles 24 are visible from outside the connected upper housing 12 and lower housing 14, as are the thumb actuator 22 and the twist cap 18. All the other components described here are invisible when the bath brush 10 is assembled.

In an embodiment of the invention that was built and tested and shown to be operative, the upper housing 12 and the lower housing 14 were made of acrylic that is adapted to be injection-molded in production. The tank 28 was also made of acrylic, as was the twist cap 18. The cylinder 48 and the piston 42 were made of polypropylene. Gaskets and seals (not further identified here) were made of polyvinyl chloride or thermoplastic rubber (TPR), and the bristles 20 were nylon. These represent choices that were made out of the many possible choices known to those skilled in the art.

The foregoing description of the bath brush 10 of the present invention is intended to make its operation clear. The description should not be taken as limiting; the invention should be limited only by the following claims.

I claim:

1. A bath brush for containing and supplying fluids such as liquid soap, liquid detergent, and the like to a user, the bath brush comprising:

an upper housing;

a lower housing;

a handle connected to the upper and lower housings;

a tank mounted in the upper housing;

a set of bristles connected to the lower housing;

an actuator mounted in the upper housing to operate a pump to permit a user to supply fluid from the tank to the bristles;

a pump connected to the tank and the actuator to be operated by the actuator to admit fluid to the pump and deliver fluid to the bristles;

a spring mounted in the upper housing to return the actuator to an initial position after the actuator has been operated to supply fluid for use;

a port for passing fluid from the pump to the bristles; and a twist cap.

2. The bath brush of claim 1 wherein the bristles are mounted in a bristle block connected to the lower housing that includes a port to pass fluid from the pump through the bristles.

3. The bath brush of claim 1 wherein the pump is connected to a nipple that passes through the bristle block to deliver fluid from the tank to the bristles.

4. The bath brush of claim 1 wherein the pump delivers a measured amount of fluid to the bristles.

* * * * *